US008789297B1

(12) United States Patent
Doyle et al.

(10) Patent No.: US 8,789,297 B1
(45) Date of Patent: Jul. 29, 2014

(54) DISPOSABLE SHOE COVER FOR BOWLING

(71) Applicants: Sean Doyle, Brentwood, TN (US); Jaime Settles, Brentwood, TN (US)

(72) Inventors: Sean Doyle, Brentwood, TN (US); Jaime Settles, Brentwood, TN (US)

( * ) Notice: Subject to any disclaimer, the term of this patent is extended or adjusted under 35 U.S.C. 154(b) by 0 days.

(21) Appl. No.: 13/957,200

(22) Filed: Aug. 1, 2013

Related U.S. Application Data

(63) Continuation of application No. 13/875,203, filed on May 1, 2013.

(60) Provisional application No. 61/642,067, filed on May 3, 2012.

(51) Int. Cl.

| | |
|---|---|
| ***A43B 5/00*** | (2006.01) |
| ***A43B 13/22*** | (2006.01) |
| ***A43B 13/12*** | (2006.01) |
| ***A43B 3/16*** | (2006.01) |
| ***A43B 5/18*** | (2006.01) |
| ***A43B 3/10*** | (2006.01) |

(52) U.S. Cl.

CPC ..... *A43B 3/16* (2013.01); *A43B 13/223* (2013.01); *A43B 13/122* (2013.01); *A43B 5/18* (2013.01); *A43B 3/108* (2013.01); *A43B 3/163* (2013.01); *A43B 3/106* (2013.01)

USPC ..... 36/130; 36/7.1 R; 36/59 R

(58) Field of Classification Search

CPC ..... A43B 5/18; A43B 13/122; A43B 13/223; A43B 3/106; A43B 3/107; A43B 3/108; A43B 3/163; A43B 3/166; A43B 3/18; A43B 3/20; A43B 3/22; A43B 3/16; A43B 1/02; A43B 1/04

USPC ..... 36/130, 7.1 R, 59 R, 7.3, 8.1

See application file for complete search history.

(56) References Cited

U.S. PATENT DOCUMENTS

| | | | | | |
|---|---|---|---|---|---|
| 1,587,377 | A | * | 6/1926 | Grosjean | 36/59 B |
| 1,714,026 | A | * | 5/1929 | Humphries | 428/45 |
| 2,371,689 | A | * | 3/1945 | Gregg et al. | 36/30 R |
| 2,400,487 | A | * | 5/1946 | Clark | 428/89 |
| 2,986,823 | A | * | 6/1961 | Kos | 36/7.1 R |
| 3,084,459 | A | * | 4/1963 | Colman | 36/7.1 R |
| 3,099,885 | A | * | 8/1963 | Jordan et al. | 36/59 R |
| 3,634,954 | A | | 1/1972 | Larsen et al. | |
| 4,023,281 | A | * | 5/1977 | Terry | 36/7.1 R |
| 4,120,103 | A | | 10/1978 | Colby | |
| 4,598,485 | A | * | 7/1986 | Joe et al. | 36/7.2 |
| 5,228,215 | A | | 7/1993 | Bayer | |

(Continued)

*Primary Examiner* — Ted Kavanaugh

(74) *Attorney, Agent, or Firm* — Waddey Patterson; Mark A. Pitchford

(57) ABSTRACT

A temporary, disposable shoe cover for bowling includes an upper, a sole having a first sole portion and a second sole portion, and a retainer. The upper is made of a fabric. A bottom opening of the upper is attached to a perimeter of the sole. A top opening of the upper is adapted to receive the user's shoe and/or foot. The retainer is attached to (i.e., at or near) the top opening of the upper and is operable to retain the shoe cover on the user's shoe and/or foot. The first sole portion is on an anterior portion of the sole and made of a low friction fabric (e.g., felt, cotton, or a nonwoven fabric). The second sole portion is on a posterior portion of the sole and made of a high friction fabric (e.g., rubber, rubber impregnated cotton, or flannel backed cotton with nonskid vinyl or rubber dots).

8 Claims, 2 Drawing Sheets

(56) References Cited

U.S. PATENT DOCUMENTS

| | | | | |
|---|---|---|---|---|
| 5,763,337 | A * | 6/1998 | Montgomery | 442/398 |
| 5,822,884 | A * | 10/1998 | Roeder | 36/7.1 R |
| 6,598,324 | B1 | 7/2003 | Tsuji | |
| 6,774,063 | B2 * | 8/2004 | Bouchette et al. | 442/151 |
| 6,833,171 | B2 * | 12/2004 | Campbell et al. | 428/36.8 |
| 7,654,015 | B2 | 2/2010 | Nakayama | |
| 7,700,021 | B2 * | 4/2010 | Cox et al. | 264/132 |
| 2002/0032974 | A1 * | 3/2002 | McCrindle | 36/130 |
| 2003/0009919 | A1 * | 1/2003 | Stein | 36/59 R |
| 2004/0107603 | A1 * | 6/2004 | Wei | 36/59 R |
| 2006/0086002 | A1 * | 4/2006 | Vickers | 36/7.1 R |
| 2006/0107551 | A1 * | 5/2006 | Teng | 36/30 R |
| 2008/0052957 | A1 * | 3/2008 | Taheri | 36/7.1 R |
| 2011/0088288 | A1 * | 4/2011 | Park | 36/25 R |
| 2012/0216428 | A1 | 8/2012 | Marandos | |

* cited by examiner

DISPOSABLE SHOE COVER FOR BOWLING

CROSS-REFERENCES TO RELATED APPLICATIONS

This application claims benefit of the following patent applications which are hereby incorporated by reference: U.S. patent application Ser. No. 13/875,203 entitled "DISPOSABLE SHOE COVER FOR BOWLING" filed May 1, 2013, and U.S. Provisional Patent Application No. 61/642,067 filed May 3, 2012 entitled "DISPOSABLE SHOE COVER FOR BOWLING".

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not applicable

REFERENCE TO SEQUENCE LISTING OR COMPUTER PROGRAM LISTING APPENDIX

Not applicable

BACKGROUND OF THE INVENTION

The present invention relates generally to temporary footwear for bowling. More particularly, the present invention related to shoe covers for use while bowling.

Most bowlers have to rent a used bowling shoe from a bowling alley when bowling at a commercial establishment. Despite the best efforts of bowling establishments, these rental shoes by their nature present hygiene issues for the bowler wearing the rented bowling shoes. Additionally, the used bowling shoes generally fit poorly and are in poor condition. From the perspective of the bowling alley operator, rental bowling shoes present a significant capital investment that have a very low utilization rate. The operator must stock shoe sizes that are rarely used, and often runs out of some shoe sizes which results in lost revenue when the potential customer cannot rent suitable bowling shoes. Further, bowling shoes wear out and are often intentionally or accidently removed from the premises by renters such that the operator must purchase replacement rental bowling shoes.

BRIEF SUMMARY OF THE INVENTION

In one aspect of the invention, a fully functional, inexpensive, and disposable (e.g., biodegradable) shoe cover for use while bowling is disclosed. The shoe cover can be worn over most types of shoes. The shoe cover is designed for a single use (e.g., five bowling games). The shoe cover is made of biodegradable fabric which can be disposed of in an environmentally friendly manner. The shoe cover provides a bowler the option of bowling in their own shoes versus renting or purchasing traditional bowling shoes, and eliminates the need for bowling alley operators to purchase and maintain large collections of traditional bowling shoes.

In one aspect of the invention, a shoe cover is operable to be worn on a shoe of the user for bowling. The shoe cover includes a sole having a first sole portion and a second sole portion. The first sole portion is made of a low friction fabric and is an anterior portion of the sole. The second sole portion is made of a high friction fabric and is a posterior portion of the sole. The shoe cover may also include an upper made of a nonwoven fabric attached to a perimeter of the sole.

In another aspect, a method of making a shoe cover operable to be worn on issue of a user includes cutting an upper from a nonwoven fabric. A second sole portion is cut from a high friction fabric, and a rear seam is sewn in the upper. The upper is attached to the second sole portion.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
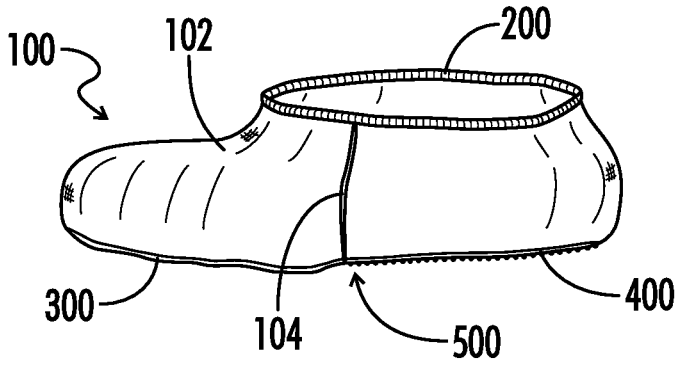
FIG. 1 is a side perspective view of the shoe cover.

Referring to FIG. 1, the shoe cover 100 includes an upper 1, a sole 500 (i.e., first sole portion 300 and second sole portion 400), and a retainer 200. In one embodiment, the shoe cover 100 is fabricated with 5 different materials (e.g., a nonwoven fabric, a low friction fabric, a high friction fabric, an elastic band, and cotton and/or nylon thread).

The upper portion 102 of the shoe cover is a light, nonwoven fabric that can remain serviceable for a single use (e.g., approximately 5 bowling games). In one embodiment, the shoe cover 100 has random pleats which help it adapt to various shoe sizes. In another embodiment, the shoe cover 100 has one or more pleats 104 at a seam between the upper 102 and the sole 500 in an area of the shoe cover 100 corresponding to a ball and/or arch of a user's foot, and in an area of the shoe cover 100 corresponding to a toe of the user's foot. It is contemplated that the upper portion 102 may include fabrics other than the nonwoven fabric.

Figure 3:
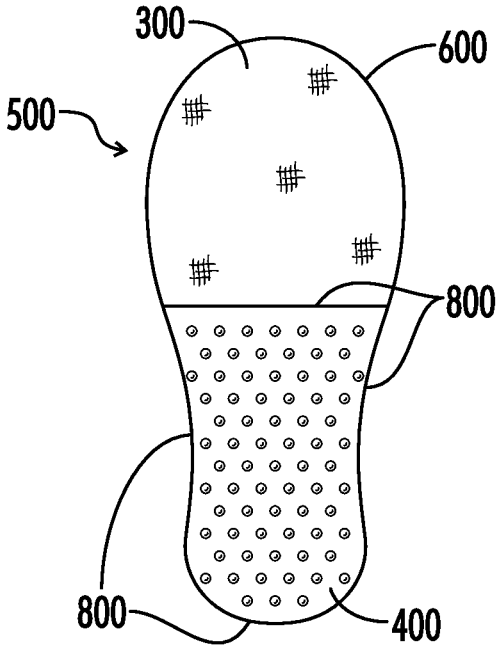
FIG. 3 is a bottom plan view of the shoe cover.

Referring to FIG. 3, the sole 500 includes a first sole portion 300 and a second sole portion 400. The first sole portion 300 corresponds to a front of the user's foot (i.e., the ball and toes of the foot). The first sole portion 300 is made of a low friction type of fabric (e.g., felt) for sliding on a bowling surface during a game of bowling (e.g., hardwood flooring). The second portion 400 of the sole 500 is made of a nonskid fabric to provide traction. In one embodiment, the nonskid fabric is rubber impregnated cotton. In another embodiment, the nonskid fabric of the second sole portion 400 is rubber backed cotton. In another embodiment, the nonskid fabric of the second sole portion 400 is flannel backed fabric with dots of vinyl or rubber (real or synthetic). Other nonskid materials are contemplated within the scope of the claims.

In one embodiment, the upper portion 102 is enclosed at a bottom of the shoe cover such that it has no bottom opening. In this embodiment, the sole 500 is attached (e.g., sewn) to the bottom of the upper portion 102 at a perimeter of the sole 500, and the bottom opening of the upper portion 102 is the point at which the perimeter of the sole 500 meets the upper portion 1. Optionally, in this embodiment, the shoe cover 100 includes a plurality of layers of nonwoven material at the first sole portion 300.

In another embodiment, the upper 102 is partially enclosed at the bottom of the shoe cover such that the upper 102 only has a bottom opening corresponding to the second sole portion 400. An edge of the upper 102 adjacent the bottom opening is attached (i.e., sewn) to a perimeter of the second sole portion 400.

Figure 2:
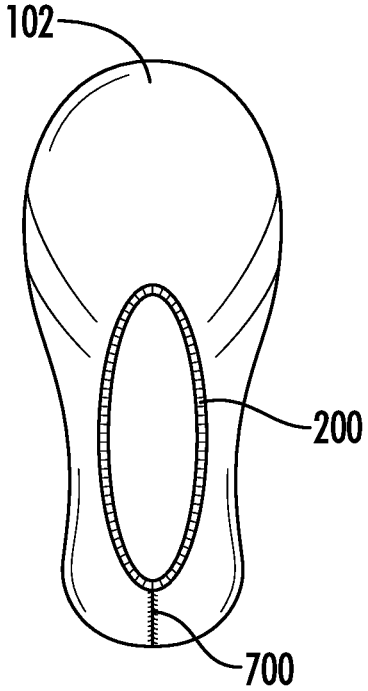
FIG. 2 is a partial top plan view of the shoe cover.

Referring to FIG. 2, the upper 102 includes a top opening for receiving the user's shoe. A size of the top opening is selectively reduced by a retainer 200. In one embodiment, a perimeter of the top opening is at least partially provided with elastic (e.g., an elastic band) which operates as the retainer 200. The retainer 200 may also include Velcro, snaps, buttons, and/or drawstrings. The sole portion 500 is attached to the upper portion 102 with a cotton thread. Other threads may be used such as nylon. In another embodiment, the upper 102 may be made of a woven fabric such as cotton.

In one embodiment, the shoe cover 100 is made in 4 different sizes which together accommodate all shoe sizes for men, women, and children.

The shoe cover 100 is intended for single use (e.g., bowling approximately 5 games) and to be disposed of after the single use. Each shoe cover 100 is constructed to fit a right or left handed bowler, to fit a right or left shoe, and needs no usage explanation to the user.

Figure 4:
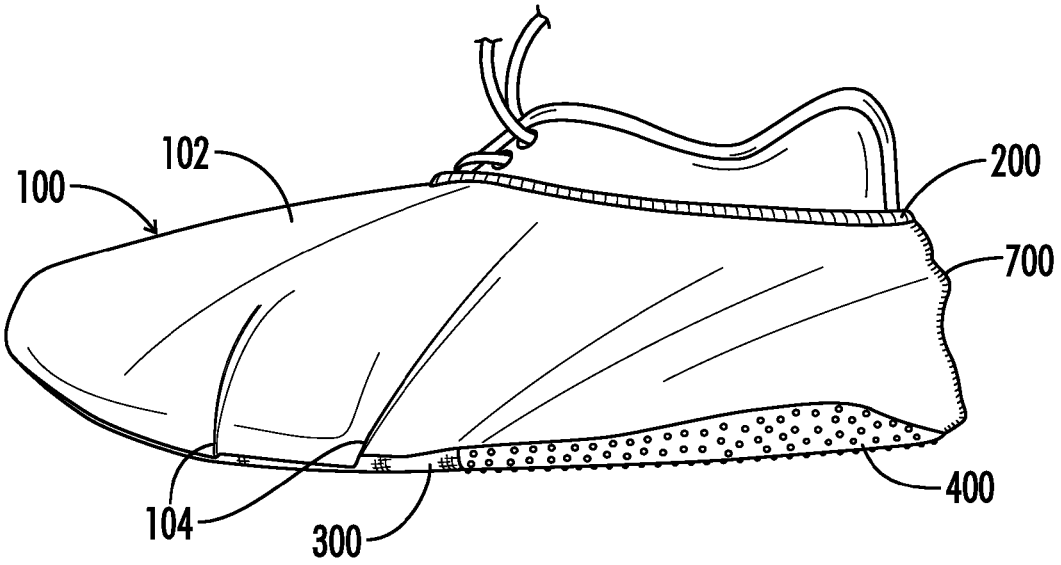
FIG. 4 is a side perspective view of the shoe cover shown fitted over a shoe.

In one embodiment, the shoe cover 100 is operable to be worn on the shoe of a user for bowling. The shoe cover 100 includes a sole 500 which has a first sole portion 300 and a second sole portion 400. The first sole portion 300 is made of a low friction fabric and makes up an anterior portion of the sole 500. In one embodiment, the low friction fabric is the same nonwoven fabric as the upper 102, and in another embodiment, the low friction fabric is felt or cotton. The first sole portion 300 may include multiple layers of fabric (e.g., the nonwoven fabric of the upper 102). The second sole portion 400 is made of a high friction fabric and makes up a posterior portion of the sole 500. In one embodiment, the high friction fabric is a flannel backed fabric having no skid dots of vinyl or rubber affixed to the fabric. A top or inside surface of the sole 500 is preferably nonslip (i.e., nonskid or relatively high friction) with respect to a sole of the shoe of the user. An outline of the sole 500 of the shoe cover 100 is larger than an outline of a sole of the shoe worn by the user such that the sole 500 of the shoe cover wraps over an edge of the sole of the shoe of the user when the shoe cover 100 is on the shoe of the user (see FIG. 4). The upper 102, which is made of a nonwoven fabric, is attached (e.g., sewn or glued) to the sole 500 of the shoe cover 100 at (i.e., adjacent to) a perimeter of the sole 500. In one embodiment, the upper 102 has a pleat 104 at a portion of the shoe cover 100 corresponding to a ball of the user's foot when the shoe cover 100 is worn by the user.

In one embodiment, the second sole portion 400 extends the length of the shoe cover 100, and the first sole portion 300 covers part of a bottom side of the second sole portion 400 at an anterior portion of the sole 500. Alternatively, the first sole portion 300 is sewn to the second sole portion 400 near a longitudinal midline of the shoe cover 100 to form the sole 500, and the sole 500 is then sewn to the upper 102 at (i.e., adjacent to) a perimeter of the sole 500 and an edge of a bottom opening of the upper 102. As yet another alternative, the rear seam 700 of the upper 102 extends from the rear (i.e., posterior end) of the upper 102 to the anterior end of the upper 102, and the sole 500 is sewn to the bottom of upper 102 to form the shoe cover 100.

In one embodiment, the upper 102 has a top opening corresponding to the ankle of the user. The top opening has a retainer 200 attached to (i.e., adjacent to) an edge of the top opening. The retainer 200 and top opening of the upper 102 expand to receive the shoe of the user into the shoe cover 100. The retainer 200 is operable to pull the shoe cover type on the shoe the user when the shoe cover has received the shoe.

One procedure for making the shoe cover 100 will now be described. It is contemplated that other materials and procedures may be used within the scope of the claims, and that the order of assembly may vary from the example below within the scope of the claims.

Step 1—As seen in FIGS. 1 and 2 the non-woven fabric of the upper 102 is attached (e.g., sewn or glued) to the elastic retainer 200 with a cotton thread to form the top opening where the foot/shoe of the user is to be inserted into the shoe cover 100. The two sides of the upper 102 are brought together and sewn at a rear seam 700 (see FIG. 2). It is contemplated that a thread other than a cotton thread may be used to assemble the shoe cover 100. For example, a nylon thread may be used. It is also contemplated that the rear seam 700 may alternatively and/or additionally be glued.

Step 2—The entire sole 500 is formed with (i.e., cut from) the anti-skid fabric of the second sole portion 400 and then the low friction fabric of the first sole portion 300 (e.g., felt) is attached (e.g., sewn or glued) to the anterior or toe/ball portion (i.e., front half) of the sole 500 with a cotton thread. See FIGS. 1 and 2. The 2nd sole portion 400 is attached to the posterior or heel portion (i.e., back) of the sole 500 with a cotton thread.

Step 3—The upper portion 102 and sole 500 are sewn together with a cotton thread to complete the shoe cover 100 with pleats 104 near a midline of the shoe cover 100 as described above. Pleats near a midline of the longitudinal axis of the shoe cover 100 allow the shoe cover to flex with the bowling motion of the user.

In another embodiment, a method of making a shoe cover 100 and operable to be worn on issue of user for bowling includes cutting an upper 102 from a nonwoven fabric. A second sole portion 400 is cut from a high friction fabric. A rear seam 700 is sewn in the upper 102 bringing together 2 sides of the upper 102, and the upper 102 is attached to the second sole portion 400. In one embodiment, attaching the upper 102 to the second sole portion 400 includes sewing an edge of the upper 102 adjacent a bottom opening of the upper 102 to a perimeter of the second sole portion 400. Additionally, the method may optionally include cutting a first sole portion 300 from a low friction fabric and attaching a perimeter of the first sole portion 300 to an edge of the upper 102 adjacent the bottom opening of the upper 102. Accordingly, the method may include attaching only a portion of the second sole portion 400 and a portion of the first sole portion 300 to the edge of the upper 102 adjacent the bottom opening of the upper 102. In some embodiments of the method, a portion of a perimeter of the first sole portion 300 is attached to a portion of the perimeter of the second sole portion 400. In one embodiment, cutting the upper from the nonwoven fabric includes cutting the first sole portion 300 from the nonwoven fabric in a single piece integral with the upper 102. In one embodiment, a plurality of first sole portions 300 are cut from the nonwoven fabric of the upper 102 and attached to an edge of the upper 102 adjacent the bottom opening of the upper 102 such that the first sole portion 300 of the shoe cover includes a plurality of layers of nonwoven fabric. The method may also include sewing a retainer 200 (e.g., an elastic band) to an edge of the upper 102 adjacent a top opening of the upper 102. It is contemplated that sewing the retainer 200 to the edge of the upper 102 may include folding the upper 102 over the elastic band and sewing the upper in upon itself to create a pocket containing the retainer 200 (e.g., the elastic band).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention of a new and useful Disposable Shoe Cover for Bowling it is not intended that such references be construed as limitations upon the scope of this invention except as set forth in the following claim.

What is claimed is:

1. A shoe cover operable to be worn on a shoe of a user for bowling, said shoe cover comprising:

a sole comprising:

a first sole portion made of a low friction fabric operable to slide on a bowling surface when the user is bowling and wearing the shoe cover on the shoe of the user, wherein the first sole portion is an anterior portion of the sole; and a second sole portion made of a high friction fabric configured not to slide on a bowling surface when the user is bowling and wearing the shoe cover on the shoe of the user, wherein:

the second sole portion is a posterior portion of the sole;

the first sole portion comprises felt; and the second sole portion comprises flannel backed fabric having non-skid dots of vinyl or rubber affixed to the fabric.

2. The shoe cover of claim 1, wherein the shoe cover is on the shoe of the user, the first sole portion is at an anterior end of the sole, the second sole portion is at a posterior end of the sole, and an outline of the sole of the shoe cover is larger than an outline of a sole of the shoe worn by the user such that the sole of the shoe cover wraps over an edge of the sole of the shoe of the user when the shoe cover is on the shoe of the user.

3. The shoe cover of claim 1, wherein the sole has a perimeter and the shoe cover further comprises an upper made of a nonwoven fabric attached to a perimeter of the sole.

4. The shoe cover of claim 1, wherein the sole has a perimeter, and the shoe cover further comprises an upper made of a woven cotton fabric attached to the sole adjacent the perimeter of the sole, wherein the upper has a pleat at a portion of the shoe cover corresponding to a ball of the user's foot when the shoe cover is worn by the user.

5. The shoe cover of claim 1, wherein a top of the sole is nonslip with respect to a sole of the shoe of the user, and wherein the top of the sole is a side of the sole on an inside of the shoe cover.

6. The shoe cover of claim 1, further comprising:

an upper having a top opening and a bottom opening prior to attachment of the sole, wherein the bottom opening of the upper is covered by attaching a perimeter of the sole to an edge of the upper adjacent the bottom opening;

a retainer attached to the top opening of the upper, wherein the top opening of the upper is operable to receive the shoe of the user into the shoe cover, retainer comprises an elastic band or a string tie, and the retainer is operable to pull the shoe cover tight on the shoe of the user when the shoe cover has received the shoe.

7. The shoe cover of claim 1, wherein:

the first sole portion comprises felt; and the second sole portion comprises flannel backed fabric having non-skid dots of vinyl or rubber affixed to the fabric.

8. The shoe cover of claim 1, wherein:

the second sole portion has a perimeter;

the shoe cover further comprises an upper having a top opening and bottom opening prior to attachment of the sole;

the bottom opening of the upper corresponds to the perimeter of the second sole portion; and the perimeter of the second sole portion is attached to the upper adjacent an edge of the bottom opening of the upper opening to cover the bottom opening.

* * * * *